US005321919A

United States Patent [19]

Scheider et al.

[11] Patent Number: 5,321,919

[45] Date of Patent: Jun. 21, 1994

[54] INTERNAL ABRADING TOOL AND METHOD OF MAKING

[75] Inventors: Alfred F. Scheider, Orange; R. Brown Warner, Westlake, both of Ohio

[73] Assignee: Jason, Inc., Cleveland, Ohio

[21] Appl. No.: 753,788

[22] Filed: Sep. 3, 1991

[51] Int. Cl.[5] ..... B24D 9/00

[52] U.S. Cl. ..... 51/330; 51/334; 15/206; 15/207.2

[58] Field of Search ..... 51/330, 331, 332, 334; 15/206, 207.1, 207.2, 159 A

[56] References Cited

U.S. PATENT DOCUMENTS

| | | | |
|---|---|---|---|
| 2,049,324 | 7/1936 | Schneider | 51/337 |
| 2,826,776 | 3/1958 | Peterson | 51/336 |
| 4,646,479 | 3/1987 | Walker et al. | 51/334 |
| 4,882,879 | 11/1989 | Warner et al. | 51/334 |

*Primary Examiner*—M. Rachuba

*Attorney, Agent, or Firm*—Renner, Otto, Boisselle & Sklar

[57] ABSTRACT

A twisted stem internal abrading tool having molded axially curved swept back filaments is formed from a twisted stem internal finishing tool having strips of abrasive containing plastic arrayed in a radial pattern about a twisted tool stem. The filament end of the tool is inserted into an undersized mold cavity thereby forcing the filaments into an axially curved swept back configuration. With the filament end of the tool fully inserted into the mold, the mold is heated and quenched to permanently fix the filaments in an axially curved bent back configuration producing an abrading tool in which the lengths of the abrasive filaments are positioned for contact with internal surfaces, maximizing the amount of abrasive material put in contact with the work surfaces and increasing the abrading efficiency of the tool.

17 Claims, 2 Drawing Sheets

INTERNAL ABRADING TOOL AND METHOD OF MAKING

DISCLOSURE

This invention relates generally to internal abrading tools of improved productivity and efficiency and more particularly to a method for making such tools.

BACKGROUND OF THE INVENTION

Twisted stem internal abrasive finishing tools such as are disclosed in Osborn Manufacturing catalog ABT-10 entitled, "Flexible Abrasive Brush Tools", and in copending patent Application Ser. No. 07/519,632 entitled "Abrasive Finishing Tool" are commonly used in the finishing of internal surfaces. These tools typically consist of individual plastic filaments containing abrasive material embedded homogeneously throughout which are placed in the bight of a cotter pin which is then clamped to form a slender shaft and twisted to hold the filaments in a radially extending arrangement. As shown in the Osborn catalog, the tool stems or shafts may be twisted to varying degrees to create a helical pattern of radially extending filaments. Such tools are effective in removing burrs, sharp edges, metal slivers from threaded bores, and in cleaning and finishing of curved internal surfaces.

The abrasive and cleaning action of such tools is accomplished primarily at the radial tips of the individual filaments which come in direct radial contact with the work piece surfaces. For applications in which the length of the filaments is approximately equal to the internal diameter of the hole to be abraded, only the tips of the filaments are utilized in the finishing process. It is desirable to have a greater portion than the tip of each abrasive filament come in contact with the work piece to increase the amount of abrasive material contacting with the work piece per revolution of the tool stem. This increases the working efficiency of the tool. However, in part because of the stiffness of the relatively short filament, it is difficult to insert an unmolded helical tool into an undersized hole. The axial curvature and bent back sweep induced into the filaments as they are forced into the hole is not of a controlled or permanent nature.

To apply a greater portion of each filament to the work piece, thereby putting a greater amount of abrasive material in contact with the work piece in a controlled and fixed manner, and increasing the working efficiency of the tool, it is desirable to have a finishing tool and a method to produce such tool in which the filaments are permanently positioned or set a transaxial in S-shape curve yet axially swept back configuration so that a portion of the length of each filament is put in contact with the work piece.

SUMMARY OF THE INVENTION

The present invention provides an internal finishing tool and method for making such tool having S-shape filaments which curve symmetrically axially transversely with respect to the slender tool stem or shaft and are also swept back axially along the length of the tool stem. The tool is formed from a twisted stem abrading tool having an array of abrasive containing plastic filaments projecting radially and sometimes helically from the stem. The end of the tool holding the filaments is forced into an undersized mold cavity of diameter less than the working face of the tool. The filaments are thereby forced into an S-shaped axially curved configuration about the tool stem or shaft and are also swept back relative to the length of the tool stem in an arc having an angular component circumferentially and/or axially of the stem as the tool is forced into the mold. With the tool inserted in the mold and the filaments held in an axially curved swept back configuration, the mold is heated and then quenched permanently to fix the filaments in the molded configuration. The tool is then removed from the reusable mold.

To the accomplishment of the foregoing and related ends, the invention, then, comprises the features hereinafter fully described in the specification and particularly pointed out in the claims, the following description and the annexed drawings setting forth in detail certain illustrative embodiments of the invention indicative, however, of but of a few of the various ways in which the principles of the invention may be employed.

DESCRIPTION OF PREFERRED EMBODIMENTS

Figure 1:
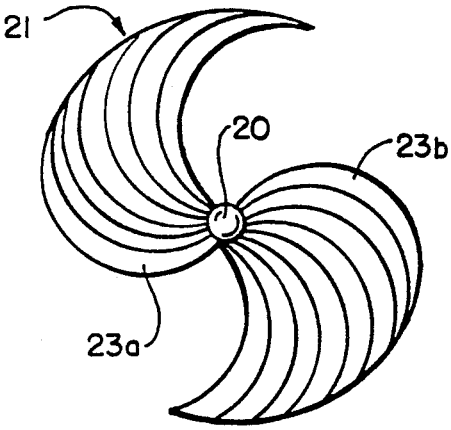
FIG. 1 is an axial schematic view of the filament end portion of a molded internal finishing tool showing an S-shape molded configuration of flat or rectangular filaments extending radially from a twisted tool stem.

FIG. 1 is a schematic axial view of the filament end of a molded twisted stem internal finishing tool. Extending from the bight portion of the tool stem 20 are one or more layers of flat or rectangular filaments, indicated generally at 21, which curve transaxially symmetrically in an S-shape about tool stem 20. Each filament is held by the tool stem at the midpoint of the length of the filament. The direction of the curvature of the filaments follows the direction of helical twist in the tool stem.

Figure 2:
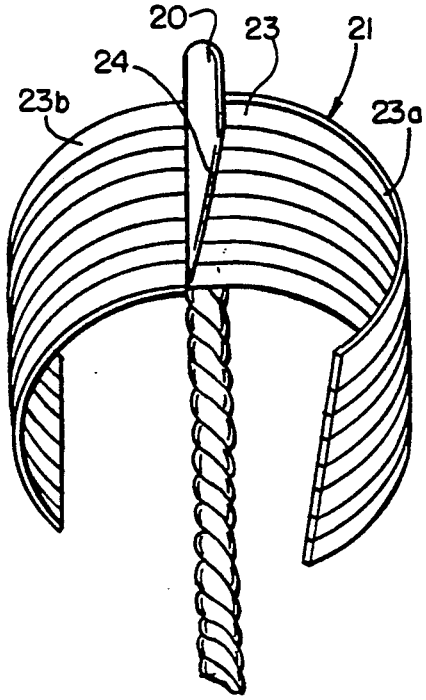
FIG. 2 illustrates from the side the molded configuration of filaments extending axially curved.

FIG. 2 illustrates the tool of FIG. 1 from the side showing the axially curvature and swept back configuration of the filaments 21 relative to the length tool stem 20. With reference to individual filament 23 more clearly in FIG. 1, it is seen that axial curve 23*a* is symmetrical to axial curve 23*b* about stem 20, thus forming the S-shape in the filament. Since the bight portion of the stem gripping the filaments at their mid-points has imparted thereto a slight or low angle helix as seen at 24 each succeeding S-shape curved filament will be slightly rotationally offset.

The swept back configuration of the filaments seen in FIG. 2 creates a common axially component to each of the two curvatures of the S-configurative 23*a* and 23*b*, thus the curvatures imparted to the filament has a circumferential and axial component. It is understood that more than one layer of filaments at each point along the length of the tool stem may be similarly formed. In tools which have multiple filaments stacked at each point along the length of the tool stem, and in tools with relatively long filaments, axial overlapping may occur among adjacent filaments. This provides increased depth and density to the working face of the tool for heavier applications.

Preferred materials from which to construct the filaments of the present invention include nylon, aramids, and polyesters. The preferred 6/12 nylon consists of a long-chain partially crystalline synthetic polymeric amides which exhibits excellent resistance to oils and greases, and has superior performance against repeated impact abrasion and fatigue. Desirable physical properties of nylon 6/12 include a low co-efficient of friction, high tensile strength, and toughness. Useful mechanical properties include strength, stiffness and toughness. The nylon polymer chain of amide linkages may be altered to achieve greater stiffness, high tensile strength and higher melting point. Other useful forms of nylon applicable to the present invention include:

(a) Nylon 6/6 synthesized from hexamethylenediamine (HMD) and adipic acid;

(b) Nylon 6/9 synthesized from HMD and azelaic acids;

(c) Nylon 6/10 synthesized from HMD and sebacic acids;

(d) Nylon 6/12 synthesized from HMD and dodecanedioic acid;

(e) Nylon 6 synthesized from polycaprolactam;

(f) Nylon 11 synthesized from 11-aminoundecaianoic acid; and (g) Nylon 12 synthesized from polyaurolactam.

Another type of polyamide useful as a substrate for the filaments of the present invention include other condensation products with recurring amide groups along the polymer chain, such as aramids. Aramids are defined as a manufactured fiber in which at least 85% of the amide (—C(O)—N(H)—). Linkages are attached directly to aromatic hydrocarbon rings. This is distinguished from nylon which has less than 85% of the amide linkages attached directly to the two aromatic rings.

Aramid fibers are characterized by high tensile strength and high modulus, and also demonstrate a very strong resistance to solvents.

Some thermal set polymers are also useful in the present invention. Polyesters with at least 85% of dihydric alcohol ester (HOROH) and terephthalic acid can be used to produce polyester filaments having both crystalline and non-crystalline regions. Polyesters are resistant to solvents and demonstrate a breaking elongation of 19–40%.

Polyamide and polymers containing (CONHCO) are also useful in the present invention. High temperatures stability (up to 700 degrees F) and high tensile strength of, for example, 13,500 psi, make polyamides useful as binders in abrasive filaments.

The abrasive material embedded homogeneously through out the filament substrate may vary widely in amount type and granular or grit size. For example, the abrasive material may range from aluminum oxide and silicon carbide to the more exotic polycrystalline diamond or cubic boron nitride. Each filament may contain up to about 30 to 45% by weight of abrasive material mixed homogeneously throughout the filament.

Figure 3:
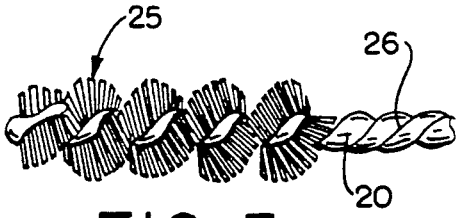
FIG. 3 illustrates the filament end portion of a twisted stem helical internal finishing tool before thermomolding.

FIG. 3 illustrates the filament end portion of a twisted stem internal finishing tool with filaments projecting radially and helically from the tool stem. Tool stem 20 is twisted about its longitudinal axis to form helical seam 26 which is continuous along the entire length of the stem. Unmolded filaments 25 extend generally perpendicular to the stem in a helical pattern. Although FIG. 3 illustrates single filaments displaced along the length of tool stem 20, it is understood that multiple filaments may be stacked adjacent one another along the length of the tool stem to form a tool with a finishing face of greater width or density than the width of a single filament. The helix angle of seam 26 and the resultant density of the helical arrangement of filaments 25 may be varied by the number of axial twists in tool stem 20, and particularly the portion of the tool stem encompassing the filaments. The filaments may be round in section or rectangular in section, or other shapes such as square, triangular, hexagonal, oval, etc.

Figure 4:
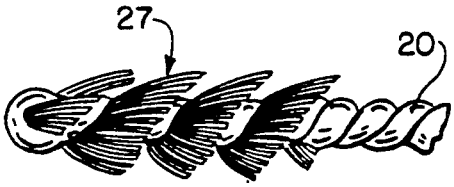
FIG. 4 illustrates an internal finishing tool in accordance with the present invention having molded filaments in a helical arrangement about the tool stem and which also axially curve about the axis of the tool stem and are swept back along the length of the tool stem.

FIG. 4 illustrates the filament end of a twisted stem internal finishing tool in accordance with the present invention with a radial helical array of molded filaments 27 along the length of the tool stem 20, each filament having the compound curvature as illustrated in FIGS. 1 and 2. The manner in which the filaments are swept back along the length of the tool stem can be seen in contrast to the generally perpendicular extension of the straight filaments 25 in FIG. 3.

Figure 5:
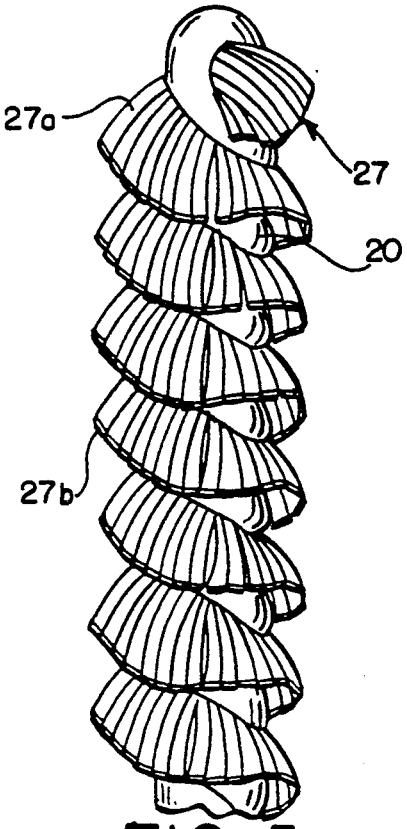
FIG. 5 is an enlarged view of the working end of a molded internal finishing tool with flat or rectangular filaments showing the axially curved, swept back shape of the filaments relative to the tool stem.

FIG. 5 is an enlarged view of the filament end of a twisted stem internal finishing tool with filaments 27 in an S-shape circumferential and axially curved swept back configuration extending radially and helically from twisted stem 20. From this view it can best be seen how the length portion 27*a* of each filament is positioned generally parallel to or in a curvature plane having a slight angle to the tool stem 20 for flat face contact with the internal surface of the work piece. The curved filament shape positions a greater amount of the surface area of each filament for contact with the work piece thereby increasing the working efficiency of the tool by putting a greater amount of abrasive material in contact with the work piece per revolution of the stem. Positioning the length of each filament against the work piece also creates a broader, continuous working face to the tool.

Figure 6:
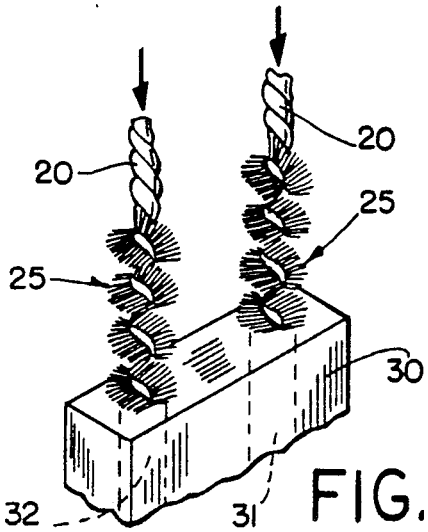
FIG. 6 schematically illustrates the filaments ends of finishing tools partially inserted into cylindrical mold cavities.

FIG. 6 illustrates two twisted stem internal finishing tools, similar to that shown in FIG. 3, being inserted into a double cavity mold 30. The diameter of cylindrical mold cavities 31 and 32 of mold 30 is less than the length of working tip to working tip diameter of the unmolded filaments 25. For example, the filaments of an unmolded tool extending generally perpendicular to the tool stem may have a diameter of about 0.515 inches (13.08 mm). The diameter of a cylindrical mold cavity into which the tool is inserted may be about 0.350 inches (8.89 mm). This is approximately a one-third reduction of the outer diameter of the tool.

A wide range of tool sizes may be molded by the present invention. For example, the outer diameter of the tools produced by this method may range from about 0.030 inches (0.762 mm) to about 15 inches (381 mm). Similarly, the cross-section diameter of the filaments used in the tools may vary from about 0.010 inches (0.254 mm) to about 0.090 inches (2.286 mm). The size reduction of the outer diameter of the tool will vary from, for example, about 20% to about 50%, depending on the cross-section diameter of the filaments. For example, filaments of small diameter (0.010 inches) will incur a molded reduction of approximately 50%, resulting in a very flexible filament. Filaments of diameter of, for example, 0.050 inches, will incur a molded reduction of approximately 30%, resulting in a slightly stiffer filament. Rectangular filaments of dimensions, for example, 0.045 inches by 0.090 inches, will undergo a molded reduction of about 20 to 25% resulting in very stiff filaments.

To accomplish insertion of the tool into an undersized mold cavity, the tool stem 20 is forced radially and axially downwardly into the mold cavity as shown to maintain concentricity. Compression of the filament tips against the walls of the mold cavity induces the axial curvature of the filaments 25. Forward axial insertion of the tool into the mold cavity also induces the swept back curvature of the filaments as they bend against the mold cavity walls relative to the forward progression of the tool stem. The small size of the mold cavity relative to the filament diameter and working face circumference of the tool holds the filaments in the S-shape axially curved swept back configuration once the filament end of the tool is fully inserted into the mold.

Figure 7:
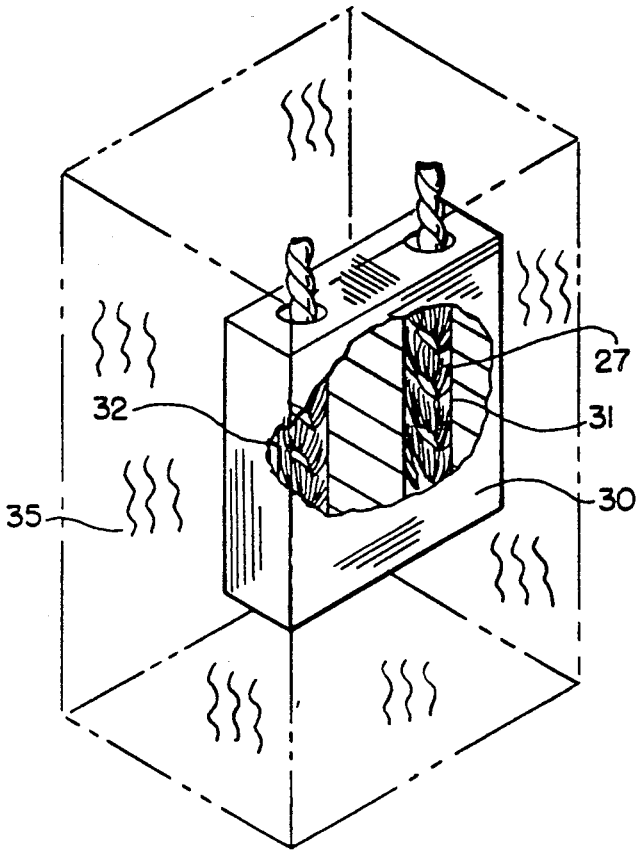
FIG. 7 illustrates the mold with the filament ends of two finishing tools inserted into the cavities and the mold placed in an oven for heating.
Figure 8:
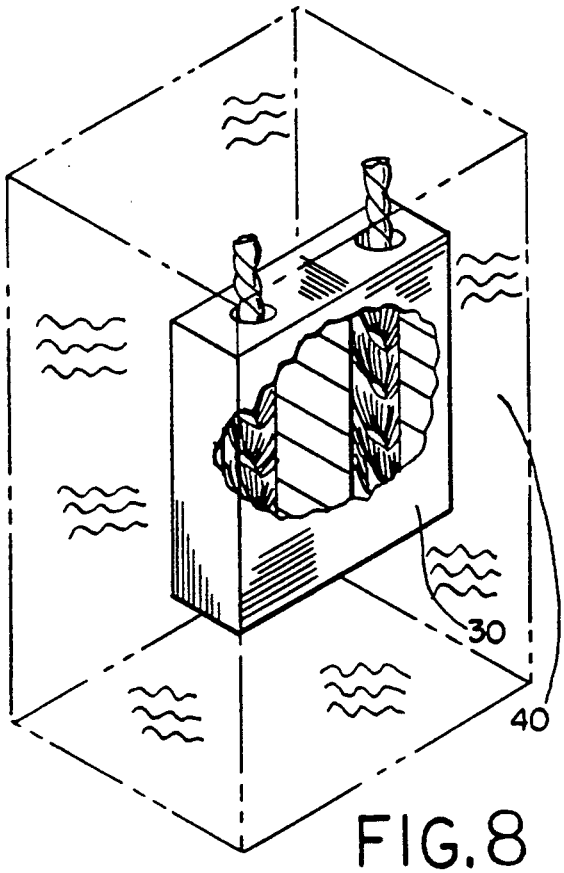
FIG. 8 illustrates the mold with the two internal finishing tools inserted therein, placed in a body of water for quenching.

As shown in FIG. 7, with the mold 30 containing the filament end of the tool or tools, the mold is placed in an oven or tunnel oven 35 and heated to, for example, about 250 degrees Fahrenheit (500 degrees Fahrenheit for molding of aramid based filaments). The mold is kept in the heated oven for approximately 15 to 20 minutes. A portion of the mold 30 is broken away as illustrated to show the filaments 27 held in the molded configuration in mold cavities 31 and 32 during heating. As illustrated in FIG. 8, immediately upon removal of the mold from the oven, the mold is placed in a quenching tank 40 containing water at a temperature of, for example, 65 degrees to 75 degrees Fahrenheit. Quenching of the mold containing the thermally molded filament end of the tool or tools permanently fixes the filaments in the above described molded configuration. It will be appreciated that the filaments may be heated or at least partially heated before insertion into the undersized mold cavity.

Figure 9:
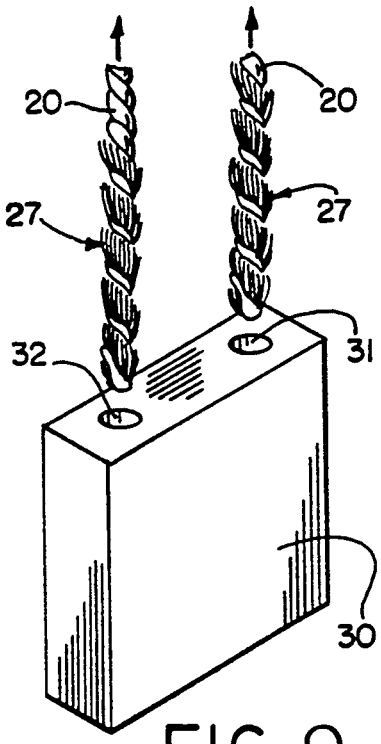
FIG. 9 illustrates finishing tools in accordance with the present invention as they are removed from the mold cavities.
Figure 10:
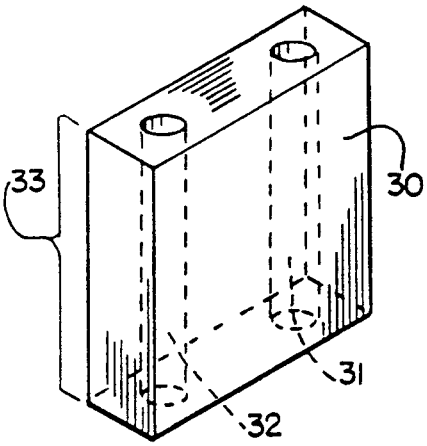
FIG. 10 illustrates a reusable mold and its internal cavities into which the filament end of the tool is inserted.

As illustrated in FIG. 9, upon removal of the mold from the quenching tank, the tools having molded filaments 21 are removed from the mold cavities 31 and 32 as indicated. As shown in FIG. 10, upon removal of the tools from the mold cavities 31 and 32 of mold 30, the mold may be reused for thermal forming of additional tools. It will also be noted from FIG. 10 that the mold 30 may be used to form tools in which the length of the filament arrangement varies up to the length 33 of the mold.

We claim:

1. A method of making an internal abrading tool comprising the steps of providing an abrasive tool having an array of abrasive containing plastic filaments projecting radially from an axial stem, said stem being in the form of a slender shaft adapted to hold said filaments, inserting the filament holding end of said slender shaft into an undersized cylindrical hole to curve the filaments to extend in a direction generally axially of the shaft, heating the filaments, quenching the filaments, and removing the tool from the hole.

2. The method of claim 1 including the step of heating the filaments outside of the hole.

3. The method of claim 1 including the step of heating the filaments inside the hole.

4. The method of claim 1 including the step of bending the filaments into an S-shape configuration when viewed axially of the stem, when inserted into the undersized mold cavity.

5. The method of claim 1 including the step of bending the filaments through an arc having an angular component both axially and circumferentially of the stem.

6. The method of claim 1 wherein the filaments are rectangular in section.

7. The method of claim 1 wherein the filaments are round in section.

8. The method of claim 1 wherein the plastic filaments are nylon containing abrasive homogeneously throughout.

9. The method of claim 1 wherein each filament contains up to about 30 to 45% by weight of abrasive material.

10. An internal abrading tool comprising an axial stem, said stem being in the form of a slender shaft, abrasive containing plastic filaments projecting radially of the shaft, and bent through an arc having an angular component axially of the shaft, whereby said filaments extend in a direction generally axially of the shaft.

11. A tool as set forth in claim 10 wherein said filaments also have an angular component circumferentially the stem.

12. A tool as set forth in claim 10 wherein said stem is twisted so that said filaments project in a helical pattern.

13. A tool as set forth in claim 10 wherein said filaments are rectangular in cross section.

14. A tool as set forth in claim 10 wherein said filaments are round in cross section.

15. A tool as set forth in claim 10 wherein the filaments have an S-shape configuration when viewed axially of the stem.

16. A tool as set forth in claim 10 wherein said filaments are made of nylon.

17. A tool as set forth in claim 10 wherein said filaments contain up to about 30 to 45% by weight of abrasive material dispersed homogeneously throughout the nylon.

* * * * *